US006867664B2

(12) United States Patent
Bray et al.

(10) Patent No.: US 6,867,664 B2
(45) Date of Patent: Mar. 15, 2005

(54) FERRITE-FILLED, ANTISYMMETRICALLY-BIASED RECTANGULAR WAVEGUIDE PHASE SHIFTER

(76) Inventors: Joey Bray, 107-188 Waverley St., Ottawa, Ontario (CA), K2P 0V6; Langis Roy, 56 Northpark Drive, Ottawa, ON (CA), K1B 3R8

( * ) Notice: Subject to any disclaimer, the term of this patent is extended or adjusted under 35 U.S.C. 154(b) by 0 days.

(21) Appl. No.: 10/429,638

(22) Filed: May 5, 2003

(65) Prior Publication Data

US 2004/0222869 A1 Nov. 11, 2004

(51) Int. Cl.[7] ..... H01P 1/19
(52) U.S. Cl. ..... 333/158; 333/24.1; 333/248
(58) Field of Search ..... 333/24.1, 157, 333/158, 161, 248

(56) References Cited

U.S. PATENT DOCUMENTS

| | | | | |
|---|---|---|---|---|
| 3,760,300 A | | 9/1973 | Leahy | |
| 4,353,042 A | | 10/1982 | D'Oro et al. | |
| 4,434,409 A | | 2/1984 | Green | |
| 4,434,426 A | | 2/1984 | Gaglione et al. | |
| 4,467,292 A | * | 8/1984 | Ajioka et al. | 333/24.1 |
| 4,818,963 A | | 4/1989 | Green | |
| 4,881,052 A | | 11/1989 | Stern et al. | |
| 4,884,045 A | | 11/1989 | Alverson et al. | |
| 5,144,319 A | | 9/1992 | Roberts | |
| 5,170,138 A | | 12/1992 | Roberts et al. | |
| 5,438,167 A | * | 8/1995 | McClanahan et al. | 174/264 |
| 5,828,271 A | | 10/1998 | Stitzer | |
| 5,876,539 A | * | 3/1999 | Bailey et al. | 156/89.16 |
| 6,067,047 A | * | 5/2000 | Cook et al. | 342/372 |
| 6,104,342 A | | 8/2000 | Noel et al. | |
| 6,667,672 B2 | * | 12/2003 | Fowler | 333/158 |

FOREIGN PATENT DOCUMENTS

EP 0 389 672 B1 4/1996

OTHER PUBLICATIONS

Charlton, A Low–cost Construction Technique for Garnet and Lithium–Ferrite Phase Shifters, IEEE Transactions on Microwave Theory and Techniques, vol. MTT22, No. 6 Jun. 1974, pp. 614–617.

El–Sharawy et al., Dual–Ferrite Slot Line for Broadband, High–Nonreciprocity Phase Shifters, IEEE Transactions on Microwave Theory and Techniques, vol. 39, No. 12, Dec. 1991, pp. 2204–2210.

Uchimura et al, Development of a Laminated Waveguide, IEEE Transactions on Microwave Theory and Techniques, vol. 46, No. 12, Dec. 1998, pp. 2438–2443.

* cited by examiner

*Primary Examiner*—Timothy P. Callahan
*Assistant Examiner*—Terry L. Englund
(74) *Attorney, Agent, or Firm*—IPLM Group, P.A.

(57) ABSTRACT

Methods and devices for accelerating or delaying an electromagnetic signal. A rectangular waveguide phase shifter has a ferrite filled center section with a pair of magnetic bias lines placed on opposing sides of the waveguide, each bias line being adjacent to one of the two opposing sides. Each magnetic bias line creates a magnetic field in the ferrite filled center section. The resulting magnetic field in half of the center section has the same magnitude but is oppositely directed to the magnetic field in the other half of the center section. This ideally results in a zero magnetic field at the very center of the ferrite filled center section. A microwave signal propagates through the waveguide phase shifter in a direction perpendicular to the magnetic field lines. The amount of phase shift provided depends on the magnitude of the magnetic fields. These magnetic fields are controllable by adjusting the current passing through the bias lines.

20 Claims, 3 Drawing Sheets

FERRITE-FILLED, ANTISYMMETRICALLY-BIASED RECTANGULAR WAVEGUIDE PHASE SHIFTER

FIELD OF THE INVENTION

The present invention relates to electromagnetics and, more specifically, is related but not limited to methods and devices using a ferrite filled rectangular waveguide phase-shifter.

BACKGROUND TO THE INVENTION

The recent telecommunications revolution has highlighted the need for better and more efficient devices for embedding in communications devices. One field in which innovation has seemed to forestall is in microwave technology. Key pieces of technology in microwave engineering are the rectangular waveguide and the phase shifter. These two have been combined into the rectangular waveguide phase shifter, a device well-known as being used in phased array antennas to electronically produce a scanning beam.

While current waveguide phase shifters are seemingly adequate to their task, they can be quite expensive and difficult to manufacture, especially if one requires an operating frequency above 30 GHz, a range known as millimetre-waves. As is well known, as the frequency of the microwave signal increases, the required waveguide size decreases. One current waveguide and phase-shifter technology uses ferrite slabs inside a conventional air-filled rectangular waveguide. Another uses a ferrite toroid in place of the ferrite slabs while yet another uses dual ferrite toroids. As a sample of the currently available phase shifters, the reader is directed towards the following patents:

U.S. Pat. No. 3,760,300;

Japanese Patent 4,092,501;

U.S. Pat. No. 5,170,138;

U.S. Pat. No. 4,818,963;

U.S. Pat. No. 4,881,052;

U.S. Pat. No. 4,434,409;

U.S. Pat. No. 4,353,042;

U.S. Pat. No. 4,884,045; and

U.S. Pat. No. 6,104,342.

As can be imagined, manufacturing very small ferrite toroids is very difficult and expensive. Also, present rectangular waveguide phase-shifters tend to be heavy, bulky and difficult to integrate with electronic microchips. As such, present waveguide phase shifters are unsuitable for the next generation of compact communication devices.

Based on the above, there is therefore a need for a lighter, smaller, and easier to integrate waveguide phase shifter. It would also be quite advantageous if such a phase shifter provided an increased amount of phase shift than that provided by current phase shifters. It is therefore an object of the present invention to mitigate if not overcome the disadvantages of the prior art.

SUMMARY OF THE INVENTION

The present invention provides methods and devices for accelerating or delaying an electromagnetic signal. A rectangular waveguide phase shifter has a ferrite filled center section with a pair of magnetic bias lines placed on opposing sides of the waveguide, each bias line being adjacent to one of the two opposing sides. Each magnetic bias line creates a magnetic field in the ferrite filled center section. The resulting magnetic field in half of the center section has the same magnitude but is oppositely directed to the magnetic field in the other half of the center section. This ideally results in a zero magnetic field at the very center of the ferrite filled center section. A microwave signal propagates through the waveguide phase shifter in a direction perpendicular to the magnetic field lines. The amount of phase shift provided depends on the magnitude of the magnetic fields These magnetic fields are controllable by adjusting the current passing through the bias lines.

In a first aspect the present invention provides A waveguide phase shifter device for use in delaying or accelerating an electromagnetic signal, the device comprising:

a filled elongated section of said device, said section being predefined and filled with a magnetic material;

enclosure means for preventing said signal from radiating through top, bottom, and parallel side portions of said section, said enclosure means enclosing said top, bottom and side portions of said section and thereby guiding said signal in a predefined direction of propagation;

at least one magnetic means for creating at least one magnetic field in said section, said at least one magnetic field resulting in first magnetic field components in a first direction transverse to said predefined direction of propagation and parallel to a line dividing a cross-sectional area of said section into substantially equal areas and parallel to said parallel side portions of said section;

wherein said at least one magnetic field further results in second magnetic field components in a second direction parallel and opposite to said first magnetic field components.

In a second aspect, the present invention provides A waveguide phase shifter for delaying or accelerating an electromagnetic signal, the phase shifter comprising:

a waveguide section for guiding said signal in a predefined direction of propagation, said section being filled with a magnetic material and having a rectangular cross-section;

enclosure means for preventing said signal from radiating through top, bottom and side portions of said section;

at least two magnetic means for creating multiple magnetic fields in said section, said multiple magnetic fields in said section resulting in first magnetic field components and second magnetic field components;

wherein said first magnetic field components are directed in a first direction transverse to said predefined direction of propagation and parallel to a shorter side of said rectangular cross-section of said waveguide section; and said second magnetic field components are directed in a second direction opposite said first direction.

BRIEF DESCRIPTION OF THE DRAWINGS

A better understanding of the invention will be obtained by considering the detailed description below, with reference to the following drawings in which.

DETAILED DESCRIPTION

A phase shifter is a device that causes an electromagnetic signal to speed up (accelerate) or slow down (delay). Waveguide phase shifters operate on the same basic principles: the signal (usually a microwave signal) passing through the waveguide interacts with the ferrite and is either accelerated or delayed through an effect known as phase-shifting. The phase shift of the signal is controlled by adjusting a magnetic field in the waveguide.

Figure 1:
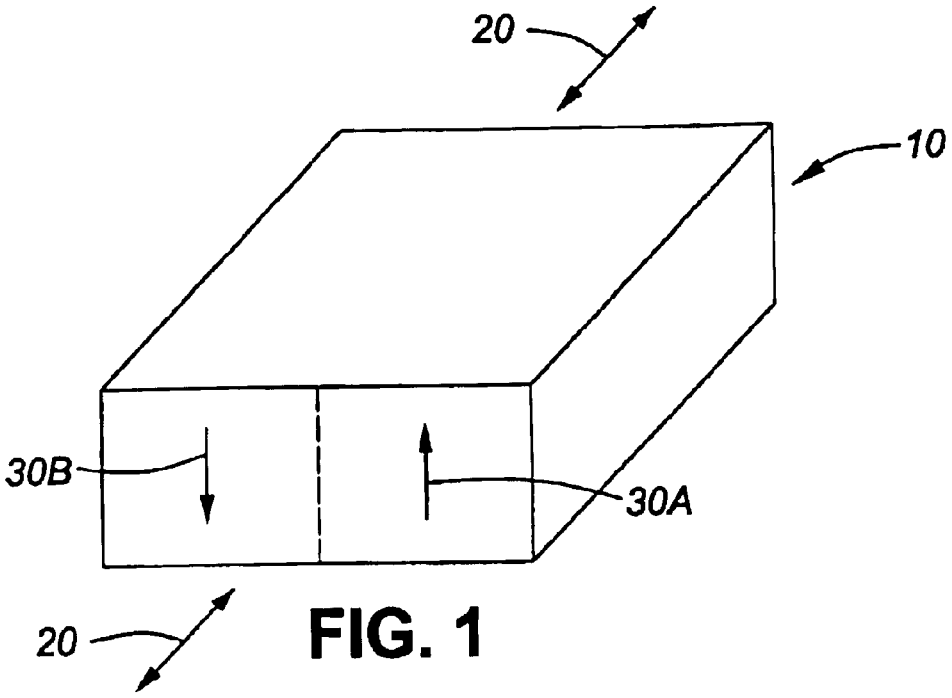
FIG. 1 is a perspective view of a waveguide device.
Figure 2:
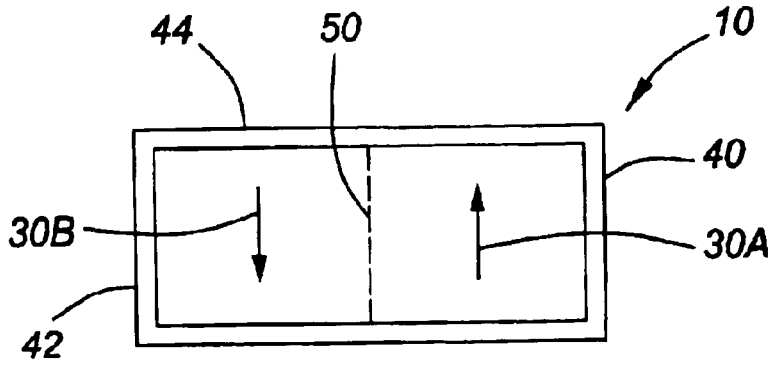
FIG. 2 is an end view of the waveguide device of FIG. 1.

Referring to FIG. 1, a block diagram of a simple implementation of the present invention is illustrated. A waveguide phase-shifter is illustrated in perspective view in FIG. 1 and in an end view in FIG. 2. Arrows 30 indicate the directions of a first and a second magnetic field in the waveguide. The waveguide 10 is a rectangular waveguide having a rectangular cross-section and the signal is prevented from radiating in all directions by means of an enclosure means 40. In FIG. 2, the enclosure means 40 is illustrated as having a rectangular box-like structure and is ideally constructed from well known metallic materials. The enclosure means 40 has, from a cross-sectional view, short walls 42 and long walls 44. As can be seen, the enclosure means 40 has a rectangular cross-sectional shape. The waveguide 10 is completely filled with a ferrimagnetic substance such as ferrite. The first and second magnetic fields (as shown by the opposing arrows 30A, 30B) are interacting to, ideally, result in a zero magnetic field in the middle (dashed line 50) of the waveguide 10, The first and second magnetic fields are, again ideally, of the same magnitude but of opposing directions. These opposing directions are both perpendicular to the direction of propagation (arrows 20 in FIG. 1 and coming out of and directed into the page in FIG. 2) of the signal, The amount of phase shift of the signal is determined by the magnitudes of the first and second magnetic fields.

Figure 3:
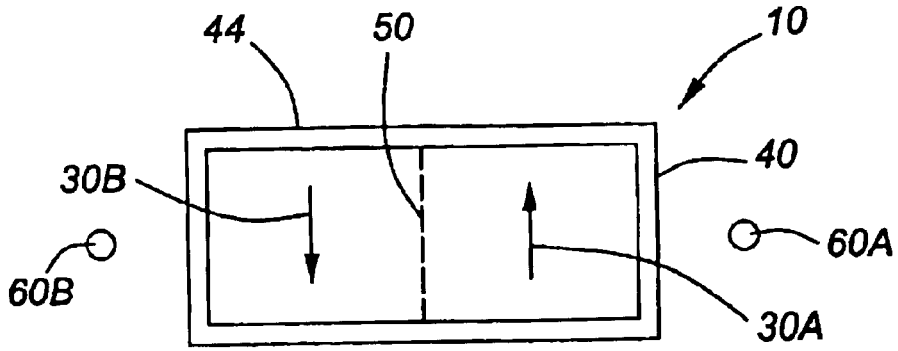
FIG. 3 is an end view of a waveguide phase shifter device according to one aspect of the invention

It should be noted that the first and second magnetic fields can be produced by any suitable magnetic means. These magnetic means may take the form of wires or any conductor which can carry a current and, thereby induce a magnetic field in the ferrimagnetic substance. Referring to FIG. 3, the first magnetic means 60A and the second magnetic means 60B respectively create the first (arrow 30A) and second (arrow 30B) magnetic fields in the ferrimagnetic substance. First and second magnetic means 60A, 60B can be wires carrying current with first magnetic means 60A carrying current flowing in a direction into the page of FIG. 3 and the second magnetic means 60B carrying current flowing in the same direction. Current travelling in these directions will cause the differently directed but parallel and ideally equal first and second magnetic fields, It should be noted that the direction of the magnetic fields in the ferrimagnetic substance need not be exactly perpendicular to the direction of propagation of the signal nor to the long walls 44. Magnetic fields which have components that are directed in a direction transverse to the direction of propagation of the signal and perpendicular to the long walls of the enclosure will also work as long as there is a corresponding and oppositely directed magnetic component present. Clearly, such components arm also parallel to the short walls of the enclosure.

Figure 4:
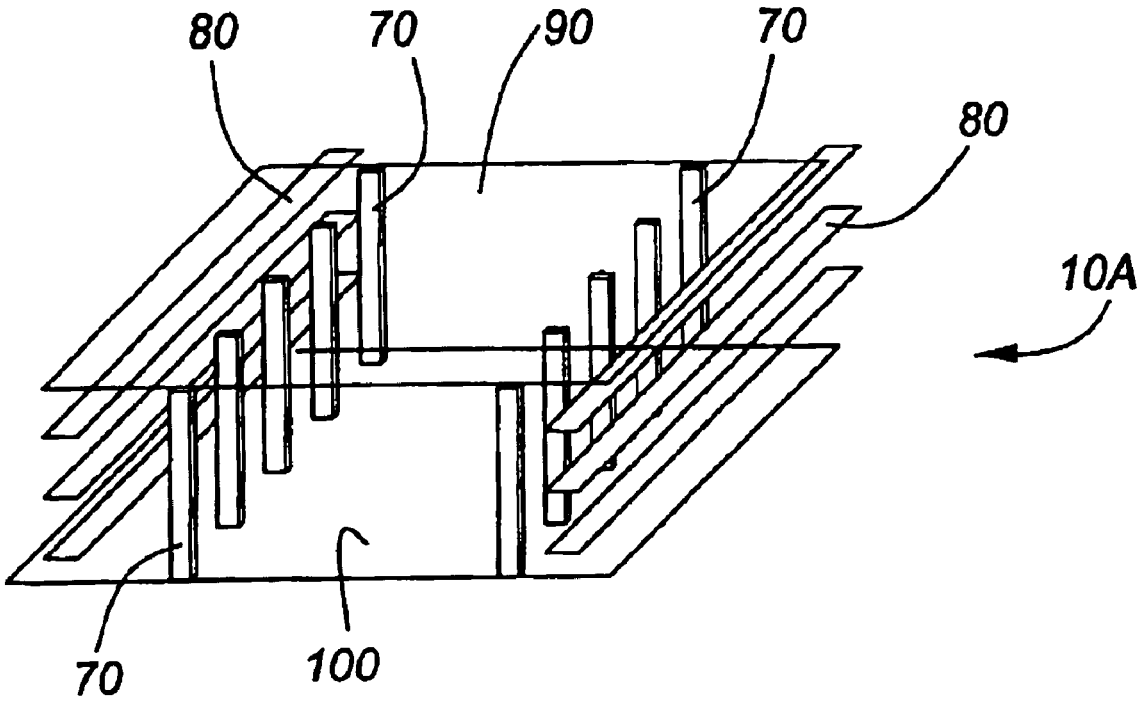
FIG. 4 is a perspective view of a waveguide phase shifter device according to another aspect of the invention

The waveguide phase shifter 10 in FIGS. 1–3 uses a conventional waveguide structure in that the top, bottom and side portion of the waveguide are solid metal conductors. FIG. 4 illustrates a waveguide phase shifter constructed using multiple layers of LTCC (low temperature co-fired ceramic). For this embodiment, each layer of the multilayer waveguide is made entirely of a ferrimagnetic substance such as ferrite. The enclosure means which prevents the signal from radiating everywhere (the metallic, box-like structure 40 in FIGS. 1 and 2) are, for this embodiment, metallic plates (solid printed conductors in an LTCC layer) at the top and bottom portions of the waveguide and two parallel rows of vias on the side portions. Vias are metal filled holes in the multi-layered waveguide with each layer having a hole corresponding to a via. The magnetic means in this embodiment takes the form of conductor lines printed on each layer. Passing current through the conductor lines creates magnetic fields in the rest of the surrounding ferrite.

Figure 5:
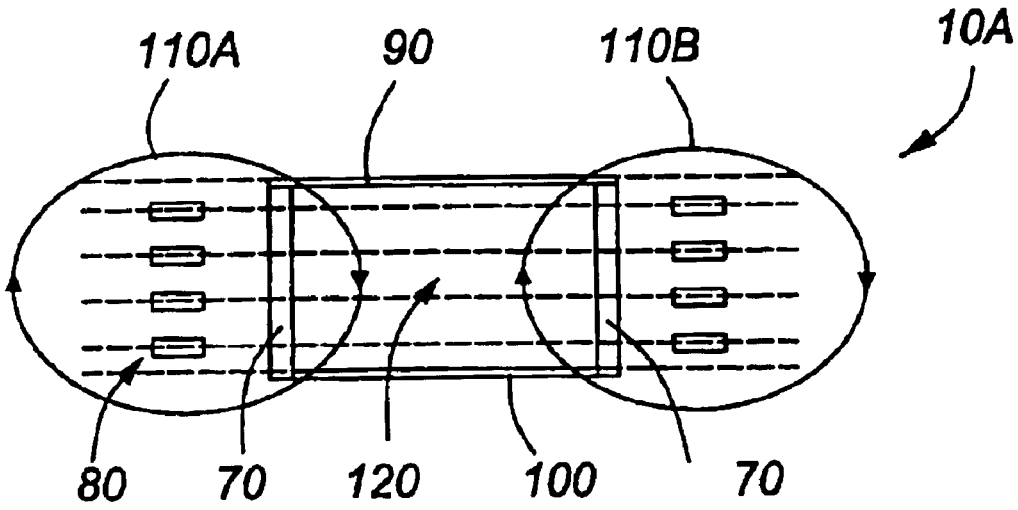
FIG. 5 is an end view of the device of FIG. 4.

Referring to FIG. 4; the vias 70 are shown as upright pillars in two parallel rows while the conductor wires 80 (bias lines) are shown as plates running transverse to the vias. The top metallic plate 90 is parallel to the bottom metallic plate 100 and to the conductor or bias lines Referring to FIG. 5, an end view of the waveguide phase shifter 10A in FIG. 4 is illustrated. The multiple layers of LTCC are shown by the dashed lines and the bias lines 80 are also clearly visible. The magnetic force lines 110A, 110B, of the first and second magnetic fields are shown as interacting to cancel each other out or at least minimize each other at the middle of the waveguide section 120.

As noted above, the current in the bias lines 80 must flow in a direction to create oppositely directed but ideally equal magnitude magnetic fields in the waveguide section 120. It should be clear that the waveguide section is the section bordered by the vias 70 and the top and bottom metallic plates 90, 100. This waveguide section 120 is completely filled with ferrite or some other ferrimagnetic material.

Figure 6:
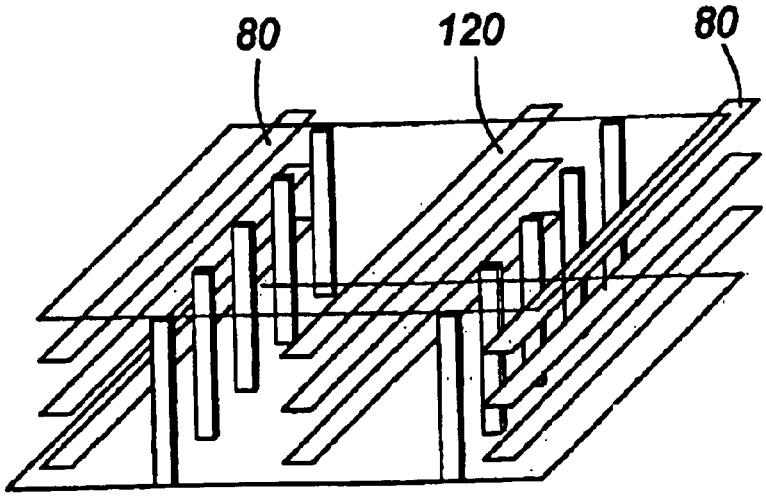
FIG. 6 is a perspective view of a waveguide phase shifter device according to yet another aspect of the invention.
Figure 7:
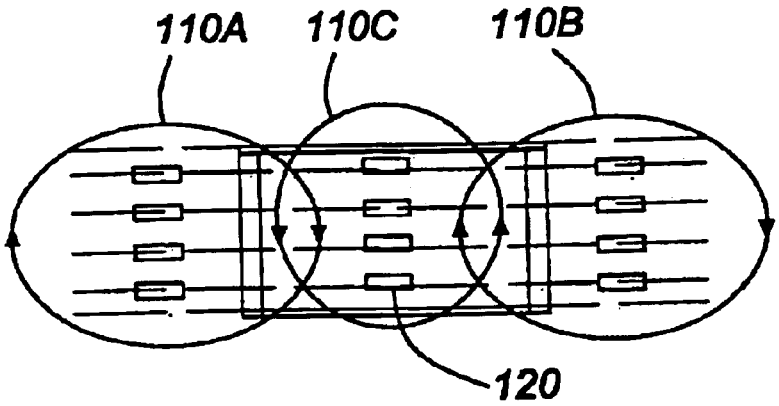
FIG. 7 is an end view of the device of FIG. 6.

Referring to FIGS. 6 and 7, another embodiment of the Waveguide phase shifter is illustrated. In both these figures, with FIG. 6 being a perspective view and FIG. 7 being an end view, it can be seen that a third set of bias lines 120 is placed inside the waveguide section 120. This third set of bias lines 120 (implemented as conductor lines printed on the LTCC layers) carries a current that causes a third magnetic field (arrows 110C) in the waveguide section 120. This third magnetic field interferes constructively with both the first and second magnetic fields (arrows 110A, 110B) as the first and second magnetic fields interfere destructively with each other. For this embodiment, the current in the first and second set of bias lines (a matched set) is directed into the page while the current in the third set of bias lines is directed out of the page.

It should be noted that the placement of the magnetic means (either the conductor wires in FIGS. 2 and 3 or the bias lines in FIGS. 4–7) is immaterial as long as they produce oppositely directed magnetic fields (both of which are perpendicular to a longer cross-sectional side of the waveguide section) in the waveguide section. As such one of the magnetic means may be placed adjacent any one of the sides of the waveguide section (such as the side portion or the top and bottom portions) while the other is placed on the opposite portion. Alternatively, the magnetic means may be placed inside the waveguide section.

Figure 8:
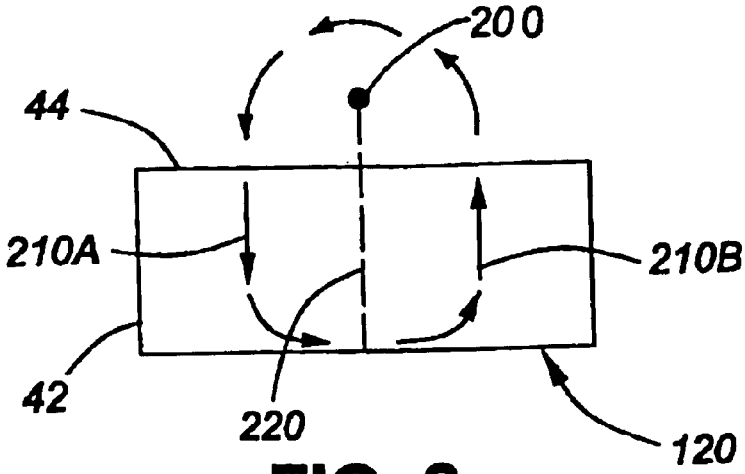
FIG. 8 is an end view of another aspect of the invention.

While the above discussion documents using two- or three magnetic means to provide the two preferably equal but oppositely directed magnetic fields, any number of magnetic means may be used to produce these fields, Referring to FIG. 8, a cross-sectional view of an embodiment using a single magnetic means is illustrated. The magnetic means is illustrated as a single conductor 200 adjacent to a long wall 44 of the ferrite-filled waveguide section 120. As can be seen, if the current passing through the conductor 200 is directed out of the page, the magnetic field this current produces will have magnetic force lines as shown in the Figure. These magnetic force lines will have components 210A and 21013 that are equal in magnitude, opposite to each other, and are perpendicular to the long wall 44 and parallel to the short wall 42 and to the centerline 220. Because of the presence of such magnetic field components, the embodiment illustrated in FIG. 8 will also provide similar advantages to the embodiments in FIGS. 3, 5, and 7 as a phase shifter.

It should be noted that the symmetry between the two cross-sectional halves of the waveguide section 120 is not accidental. The greater the symmetry between the two cross-sectional halves (each half being the area on one side of the centerline 220 of the waveguide section 120), the greater the advantage to be gained as a waveguide phase shifter. Of course, the two halves are symmetrical in that their areas are preferably equal and the magnitudes of the magnetic field components 210A and 210B are equal. The symmetry does not extend to the directions of the magnetic field lines—the magnetic field lines have to be oppositely directed to one another. Advantages in phase shifting may still be gained if the areas of the two cross-sectional halves (as defined by the magnetic field strength of the two components 210A, 210B) are not equal but such advantages may be reduced as the inequality or non-symmetry between the two cross-sectional halves increase, To achieve as much symmetry as possible for the embodiment in FIG. 8, it has been found that placing the conductor on the centerline 220 (as shown in the Figure) should produce optimum results. Moving the conductor either to the right or to the left of the centerline 220 decreases the symmetry between the two cross-sectional halves.

It should also be noted that while the above discussion mentions ferrimagnetic materials and ferrite in particular as being the filling material for the waveguide section, other materials are also suitable. Magnetic materials equally suitable as ferrimagnetic materials such as ferrite should have the following properties:

a) high saturation magnetization b) low coercivity (i.e. easily magnetizable)

c) near unity ratio of remanent magnetization to saturation magnetization (i.e. squareness ratio is high)

d) high resistivity e) low gyromagnetic resonance linewidth f) low loss tangents g) high Curie temperature Regarding the shape of the enclosure means, it has been found that the waveguide section should have a rectangular or substantially rectangular cross-section to provide what is effectively a rectangular waveguide configuration. However, as noted above, his waveguide section should be completely filled with a magnetic material having the properties listed above, A rectangular or substantially rectangular (rectangular-like) cross-sectional shape has been found to yield the best results. However, other shapes which have two sets of parallel sides have also been found to be useful.

To control the amount of phase shift that the signal undergoes, the magnitude of the two magnetic fields (or of the two magnetic field components parallel to the short wall) is controlled. It has been found that increasing the magnitudes of the magnetic fields increases the phase shift while decreasing the magnitude decreases the phase shift. As noted above, it is ideal that the magnitude of the first and second magnetic fields (or of the two magnetic field components parallel to the short wall) be equal to arrive at a minimal resultant magnetic fields strength in the center of the waveguide section. Control of the magnetic field strength for either of the first and second magnetic fields/field components can be had by controlling the amount of current passing through the different magnetic means. The greater the amount of current passing through the magnetic means creates a greater magnetic field in the waveguide section In terms of implementation ferrite LTCC tape from the company Ferro was used to construct the device. In terms of performance, using a 2.05 cm long interaction region, a phase shift of 427.4° resulting in a figure of merit of 305°/dB can theoretically be obtained at 36 GHz. For ferrite material that has a saturation magnetization of 500 mT, the resulting phase shift and figure of merit would be improved to 990° and 707°/dB at 36 GHz. This projected figure of merit rivals that of the best documented Ka band dual slab air filled phase shifter. The embodiment of the invention illustrated in FIGS. 4–8 is more compact and offers a higher degree of phase shift per unit length than currently available and known devices.

A person understanding the invention may now conceive of alternative structures and embodiments or variations of the above all of which are intended to fall within the scope of the invention as defined in the claims that follow.

We claim:

1. A waveguide phase shifter device for use in delaying or accelerating an electromagnetic signal, the device comprising:

a completely filled elongated section of said device, said section being predefined and completely filled with a magnetic material;

enclosure means for preventing said signal from radiating through top, bottom, and parallel side portions of said section, said enclosure means enclosing said top, bottom and side portions of said section and thereby guiding said signal in a predefined direction of propagation;

at least one magnetic means for creating at least one magnetic field in said section, said at least one magnetic field resulting in first magnetic field components in a first direction transverse to said predefined direction of propagation and parallel to a line dividing a cross-sectional area of said section into substantially equal areas and parallel to said parallel side portions of said section;

wherein said at least one magnetic field further results in second magnetic field components in a second direction parallel and opposite to said first magnetic field components.

2. A device according to claim 1 wherein said device is constructed from multiple layers of ferrite low temperature co-fired ceramic.

3. A device according to claim 1 wherein said enclosure means includes solid printed conductors enclosing said top and bottom portions of said section.

4. A device according to claim 1 wherein said enclosure means includes a plurality of metallic vias disposed as two parallel rows, each row being adjacent to a corresponding one of the parallel side portions.

5. A device according to claim 1 wherein said at least one magnetic means comprises at least one first conductor means placed adjacent to a corresponding one of said portions of said section.

6. A device according to claim 5 further including at least one second conductor means placed adjacent to another corresponding portion of said section.

7. A device according to claim 6 further comprising at least one third conductor means disposed in a central location inside said section.

8. A device according to claim 1 wherein a resulting magnetic field strength in a center of said section is at a minimum due to interaction between said first and second magnetic field components.

9. A device according to claim 1 wherein a strength of said at least one magnetic field is adjustable.

10. A device according to claim 1 wherein a strength of each of said at least one magnetic field is adjusted by adjusting a current passing through said at least one magnetic means.

11. A device according to claim 1 wherein a cross-sectional shape of said section is rectangular.

12. A device according to claim 1 wherein said magnetic material is a ferrimagnetic material.

13. A waveguide phase shifter for delaying or accelerating an electromagnetic signal, the phase shifter comprising:

a waveguide section for guiding said signal in a predefined direction of propagation, said section being completely filled with a magnetic material and having a rectangular cross-section;

enclosure means for preventing said signal from radiating through top, bottom and side portions of said section;

at least two magnetic means for creating multiple magnetic fields in said section, said multiple magnetic fields in said section resulting in first magnetic field components and second magnetic field components;

wherein said first magnetic field components are directed in a first direction transverse to said predefined direction of propagation and parallel to a shorter side of said rectangular cross-section of said waveguide section; and said second magnetic field components are directed in a second direction opposite said first direction.

14. A phase shifter according to claim 13 wherein said waveguide section is constructed from multiple layers of ferrite low temperature co-fired ceramic.

15. A phase shifter according to claim 13 wherein said enclosure means includes solid printed conductors enclosing said top and bottom portions of said section.

16. A phase shifter according to claim 13 wherein said enclosure means includes a plurality of metallic vias disposed as two parallel rows, each row being adjacent to a corresponding one of said side portions of said section.

17. A phase shifter according to claim 13 wherein said at least two magnetic means comprises conductor wires.

18. A phase shifter according to claim 13 further comprising a third magnetic means disposed in a central location inside said section.

19. A phase shifter according to claim 13 wherein a resulting magnetic field strength in a center of said section is at a minimum due to interaction between said first and second magnetic field components.

20. A phase shifter according to claim 13 wherein said first and second magnetic field components are substantially equal in magnitude.

* * * * *